United States Patent [19]

Jones et al.

[11] 3,930,430

[45] Jan. 6, 1976

[54] PHOTO-ELECTRIC ORGAN WITH CHIFF

[75] Inventors: Edward M. Jones, Cincinnati, Ohio; William C. Wayne, Jr., South Fort Mitchell, Ky.

[73] Assignee: D. H. Baldwin Company, Cincinnati, Ohio

[22] Filed: Apr. 17, 1974

[21] Appl. No.: 461,694

Related U.S. Application Data

[63] Continuation-in-part of Ser. No. 368,608, June 11, 1973.

[52] U.S. Cl. ..... 84/1.24; 84/1.18; 84/DIG. 5; 84/DIG. 19

[51] Int. Cl. ..... G10h 1/02; G10h 3/06

[58] Field of Search ..... 84/1.01, 1.02, 1.13, 1.18, 84/1.24, 1.26, 1.28, DIG. 5, DIG. 19, DIG. 29

[56] References Cited

UNITED STATES PATENTS

| | | | |
|---|---|---|---|
| 2,486,208 | 10/1949 | Rienstra | 84/1.26 |
| 2,989,886 | 6/1961 | Markowitz | 84/DIG. 5 |
| 2,989,887 | 6/1961 | Markowitz | 84/1.24 |
| 3,037,413 | 6/1962 | Markowitz | 84/1.24 |
| 3,180,919 | 4/1965 | Stiefel | 84/1.26 |
| 3,247,306 | 4/1966 | Milho | 84/1.13 |
| 3,333,042 | 7/1967 | Brombaugh | 84/1.13 |
| 3,391,240 | 7/1968 | Uetrecht | 84/1.01 |
| 3,445,578 | 5/1969 | Cunningham | 84/DIG. 5 |
| 3,562,400 | 2/1971 | Cutler | 84/1.26 |
| 3,617,603 | 11/1971 | Wayne et al. | 84/1.18 |
| 3,660,587 | 5/1972 | Martin | 84/1.18 |
| 3,735,014 | 5/1973 | Turner | 84/1.24 |
| 3,855,893 | 12/1974 | Chase | 84/1.24 |

*Primary Examiner*—Joseph W. Hartary
*Assistant Examiner*—Stanley J. Witkowski
*Attorney, Agent, or Firm*—Burmeister, York, Palmatier, Hamby & Jones

[57] ABSTRACT

An electrical organ in which each of the keys of the organ is mechanically coupled to one single pole single throw electrical switch, and a plurality of said switches are each connected to a plurality of photoelectric tone sources through pulse shaping keying circuits, the keying circuits connected to each key switch being connected in a cascade circuit with the direct current potential source and the photocell of one of the tone sources, the other tone sources having photocells connected to the junctions of keying circuits in said cascade circuit. The tone circuits actuated by a given key of the organ may be at the same frequency or may comprise a chiff tone component or a noise-puff component, or may include a special decay circuit which activates a photocell modulated at a different pitch from the main-tone component.

12 Claims, 8 Drawing Figures

EF#1
EF#2
EF#3
EF#4
EF#5
GATE
NOISE SOURCE
HIGH PASS FILTER
DECAY CIRCUIT
SLOW CELLS
MEDIUM CELLS
FAST CELLS
DECAY OUTPUT
INPUT FROM KEY
FAST OUTPUT #1 AND #2 AND REED OUTPUT
MEDIUM OUTPUT
SLOW OUTPUT
SLOW CHIFF
FAST CHIFF
DELAY OUTPUT
POTENTIAL

+10V
+16V
+6V
+6V
-9V
-9V
SLOW CHIFF
FAST CHIFF
FAST #1
FAST #2
REED CELLS
S
M
NOISE SOUND
GATE

PHOTO-ELECTRIC ORGAN WITH CHIFF

INTRODUCTION

This application is a continuation-in-part of application Ser. No. 368,608 filed June 11, 1973, entitled "ELECTRICAL MUSICAL INSTRUMENT". This invention relates to electrical musical instruments, such as electrical organs, and in particular relates to unique means for simulating the tones of the pipe organ with such an electric organ. The present invention is particularly related to photoelectric organs and devices for controlling the attack and decay of tones produced by such organs.

BACKGROUND OF THE INVENTION

In organs generally, it is conventional to actuate a number of tones upon depressing a given key. In many types of electrical organs, electrical tone generators may be keyed by means of an electrical switch connected between the tone generator and a source of direct current potential, the switch being actuated in response to depressing of one of the keys of the keyboard of the musical instrument. U.S. Pat. No. 3,617,603 of Nov. 2, 1971, entitled "CHIFF CIRCUITS FOR ELECTRONIC ORGANS" of Wayne and Meyer, and U.S. Pat. No. 3,660,587 of May 2, 1972, entitled "ELECTRONIC ORGAN KEYING CIRCUITS" of Martin disclose an electrical organ in which a single pole single throw key switch activates two photoelectric tone sources, corresponding, for example, to a main tone component and a chiff tone component of the organ tone through two parallel envelope circuits. As more fully described hereinafter, FIG. 1 illustrates such a system.

U.S. Pat. No. 3,390,223 to Wayne discloses an electrical organ in which certain pipe organ simulated tones decay at a pitch which is flat with respect to the steady-state pitch. In the organ of the Wayne patent, however, this is accomplished by driving, at the steady-state pitch, a resonant circuit which is tuned flat with respect to the steady-state pitch, so that when the key switch is opened and the driving signal terminates, the resonant circuit produces a decaying electrical signal at the resonant frequency of the circuit which is flat with respect to the steady-state pitch.

U.S. Pat. No. 3,037,413 to Markowitz entitled "ELECTRIC ORGAN WITH TRANSIENT SPEECH EFFECTS" is also an example of an electrical organ in which a single key is utilized to excite a plurality of tone sources through separate keying circuits connected in parallel with the keying circuit of the principal tone.

SUMMARY OF INVENTION

For any given key switch of certain types of electrical organs, tone signals which require different rise time characteristics, or different decay time characteristics, can be produced with fewer circuit components by utilizing a plurality of keying circuits connected in cascade. Electrical organs suitable for such a keying circuit require tone sources having a control terminal and which respond to a potential being impressed upon that control terminal to place the tone source in operation. Hence, a simple single-pole single-throw switch connected in series with a power source and the control terminal of the tone source is effective to control operation of the tone source. A plurality of keying circuits connected in cascade between the key and the control terminal of the tone source will thus be effective to control both the rise time and decay time of the tone produced by the tone source. In addition, other tone sources which are to be activated by the same key may be connected to the junctions between the cascade connected keying circuits to have rise times and/or decay times dictated by those keying circuits connected between that tone generator and the electrical switch. In a practical electrical organ, three such keying circuits have been connected in cascade to provide fast rise times, medium rise times, and slow rise times for the tones produced from three separate generators connected to a common key. In addition, these keying circuits connected in series with each of these generators also may be utilized to control the decay times of the tones produced from these signal sources.

It is an object of the present invention to provide an electrical organ which produces chiff and/or noise-puff components of the tone of the organ with economy of circuitry.

Another object of the present invention is to provide an electrical organ which produces pipe-organ like tones of the type that decay at different pitches from the main or steady state portion of the tones.

A still further object of the present invention is to provide an electrical musical instrument with a plurality of keying circuits connected in a cascade circuit with a direct current power source, a key switch, and a control electrode of an electrical tone source, the cascaded keying circuits providing a desirable rise characteristic to the electrical audio tone produced by the tone source on closing of the key switch, and in which the control electrode of other tone sources is connected to the junction between adjacent cascaded keying circuits to provide suitable rise times for the audio tone signals produced by these tone sources also.

The above objects and still further objects, features and advantages of the present invention will become apparent upon consideration of the following detailed description of a specific embodiment thereof, especially when taken in conjunction with the accompanying drawings, in which.

DESCRIPTION OF THE PREFERRED EMBODIMENT OF THE INVENTION

Figure 1:
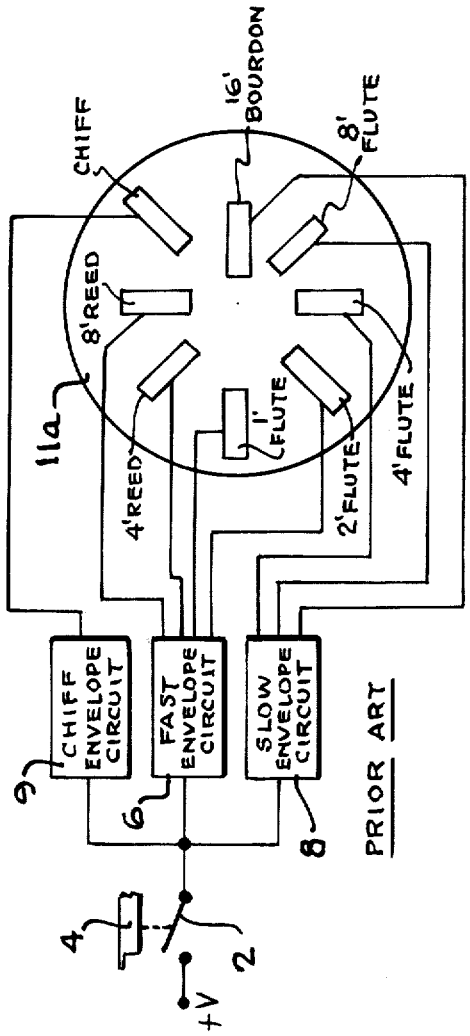
FIG.1 PRIOR ART
FIG. 1 is a schematic circuit diagram of a portion of a photoelectric organ known to the prior art.

FIG. 1 illustrates the prior art parallel keying circuits described in detail in U.S. Pat. No. 3,617,603 of Wayne and Meyer, and U.S. Pat. No. 3,660,587 of Martin. A single pole single throw key switch 2 has a pair of contacts actuated by a playing key 4 of a conventional keyboard (not shown) of the electric organ. The switch 2 has one contact directly connected to one terminal of a direct current potential source, designated as +V, and the other terminal of the switch 2 is connected to a fast envelope circuit 6, a slow envelope circuit 8, and a chiff envelope circuit 9. Hence, closing of the switch 2 applies the potential +V to the inputs of all three envelope circuits 6, 8 and 9 simultaneously.

The fast keying circuit 6 has multiple output connections which are connected to a plurality of different arrays of photocells in the organ, the photocells being indicated in FIG. 1 on a disc 11*a* as the 8' Reed, 4' Reed, 2' Flute, and 1' Flute. The slow envelope circuit 8 also has multiple output terminals which are connected to a plurality of different photocell arrays indicated as the 16' Bourdon, 4' Flute and 8' Flute. The attack required for the 8' Reed, 4' Reed, 1' Flute, and 2' Flute is relatively fast, and this can be achieved from the fast envelope circuits, while the attack for the 4' Flute, 8' Flute, and 16' Bourdon are relatively slow, and this is achieved by the slow envelope circuit 8. Thus from a single key switch 2, the photocells for both relatively fast starting tones and relatively slow starting tones are energized from a single direct current source +V.

Figure 2:
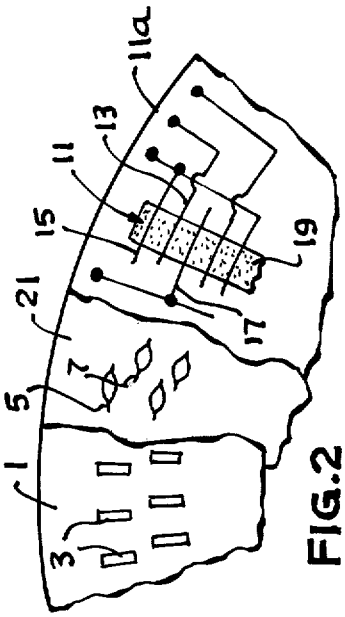
FIG. 2 is a broken-diagramatic and partly schematic view of a portion of a photoelectric organ suitable for carrying out the prior art organ of FIG. 1 and a portion of the preferred embodiment of the present invention.

FIG. 2 illustrates the construction of the tone generators used in the prior art organ of FIG. 1 and also used in the preferred embodiment of the present invention. The organ has a light source (not shown for simplicity) which produces radiation falling upon a pitch disc 1. The pitch disc 1 is maintained rotating at a constant rate by a motor (not shown). The pitch disc 1 has transparent slots 3 equally spaced in a plurality of concentric circles, one circle for each musical pitch, and rotation of the pitch disc 1 causes apparent moving beams of light to scan wave form patterns illustrated at 5 and 7 in a stationary wave form disc 21. The patterns 5 and 7 may either be of the variable area or variable density type. The wave form patterns 5 and 7 determine the timbre of the tones produced by the electrical organ.

The modulated light produced by the beams of light fall upon photocell arrays, one of which is illustrated at 11. The photocell array 11 is disposed upon the stationary plate 11*a*, diagramatically illustrated in FIG. 1 and illustrated in FIG. 2. Each array of photocells comprises a plurality of pairs of photocells for use in a push-pull circuit. Each pair of photocells has a keying electrode 13 disposed between two collecting electrodes 15 and 17, and a layer 19 of photosensitive material, such as cadmium selenide, is disposed in a ribbon over all three electrodes 15, 13 and 17. The physical layout of a photocell array is further described hereinafter in connection with FIG. 4.

Figure 3:
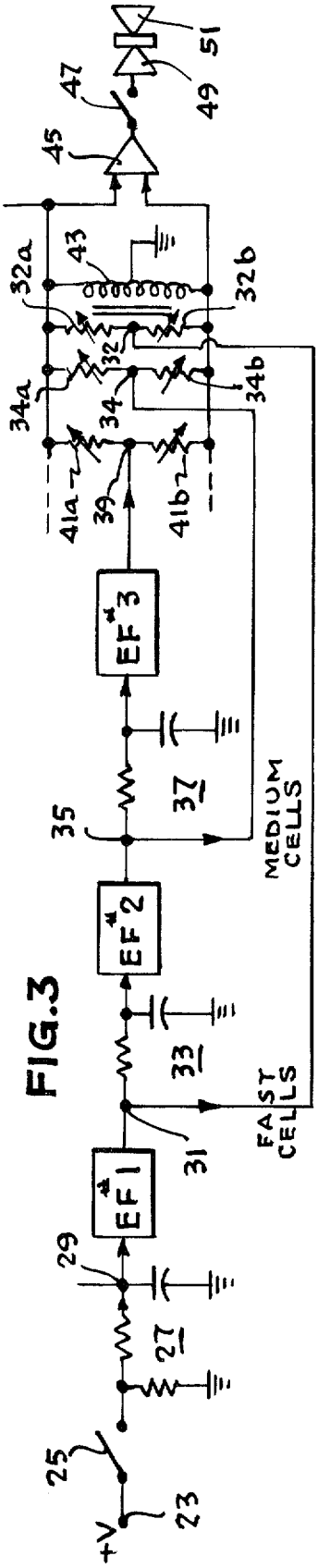
FIG. 3 is a schematic diagram of a portion of a photoelectric organ of the type illustrated in FIG. 2 constructed according to the teachings of the present invention.

FIG. 3 discloses the basic elements of a photoelectric organ employing cascade keying circuits according to the present invention. A source of direct current activating potential +V is connected to the terminal 23 to which all key switches of the instrument are connected, the key switch 25 being illustrated. It is to be understood that FIG. 3 illustrates the keying circuits for only one key and key switch of the electric organ and that similar keying circuits are utilized with each of the other key switches of the electric organ. The switch 25 has a second contact connected to an envelope circuit 27 containing only passive elements and having an output point 29. An emitter follower, designated EF No. 1, is connected to point 29, the emitter follower EF No. 1 having an output point 31.

Upon closing of the key switch 25, a potential having a very rapid rise time appears on the contact of the key switch connected to the envelope circuit 27, the rise time being extremely short. The envelope circuit 27 modifies this rise time to provide the fast attack desired and necessary for certain tones of the electric organ, and the fast attack is preserved by the emitter follower EF No. 1 to appear on the point 31. Hence, the potential appearing on the point 31 may be utilized directly to drive the control electrode 32 of a pair of photocells 32*a* and 32*b* which are utilized to produce tones which require a fast onset or attack.

The point 31 is also connected to a second envelope circuit 33, and the second envelope circuit is connected to another emitter follower designated EF No. 2. The output of the emitter follower EF No. 2 is connected to point 35.

Since closing of this key switch 25 produces a pulse on point 31 with a short rise time, but a rise time which has been modified by the envelope circuit 27 to be significantly longer than the rise time at the key switch 25 itself, the envelope circuit 33 may achieve a further delayed rise time on the point 35 utilizing the potential which appears on the point 31. The point 35 is connected to the control element 34 of a pair of photocells 34*a* and 34*b* which are positioned with respect to the rotating pitch disc of the photoelectric organ to require slower onsets than the photocell 32*a* and 32*b*. The photocells 34*a* and 34*b* are referred to as the medium cells, while the photocells 32*a* and 32*b* are referred to as the fast cells.

The point 35 is connected to still another envelope circuit 37, which in turn is connected to an emitter follower EF No. 3. The output of the emitter follower EF No. 3 is connected to the control electrode 39 of a pair of photocells 41*a* and 41*b*. It should be noted that the photocells in FIG. 3 are illustrated as variable resistors, but they are identical in construction to the photocells of FIG. 2. The envelope circuit 37 further modifies the rise time of pulses produced by closing of the key switch 25 which appear on point 35 to further increase the rise time impressed upon the input of the emitter follower EF No. 3. In this manner, the onset of the control potential placed upon the control element 39 of the photocell assembly 41*a* and 41*b* is further retarded, and these photocells are referred to as slow cells. Thus, the keying circuits 27, 33, and 37 are connected in cascade with respect to the slow cells 41*a* and 41*b*, the emitter followers EF No. 1, EF No. 2 and EF No. 3 being utilized for isolation purposes.

The tone signal developed in the cells 32*a* and 32*b*, 34*a* and 34*b*, and 41*a* and 41*b* is conducted through a bifilar wound transformer 43 which cancels the direct current transient. The transformer 43 is connected to the input of a preamplifier 45 which is connected through a stop switch 47 and power amplifier 49 to a loudspeaker system 51 for conversion to sound. The emitter followers EF No. 1, EF No. 2 and EF No. 3 are utilized to prevent the longer decay pulses which are applied to certain of the photocells from effecting the shorter decay pulses and to prevent the wide range of impedances of the photocells from affecting each other. It is common to find photocell resistances to range between 6800 ohms and 100,000 ohms, and such changes in resistance may affect the envelope circuits 27, 33 and 37 in the absence of isolation.

Figure 4:
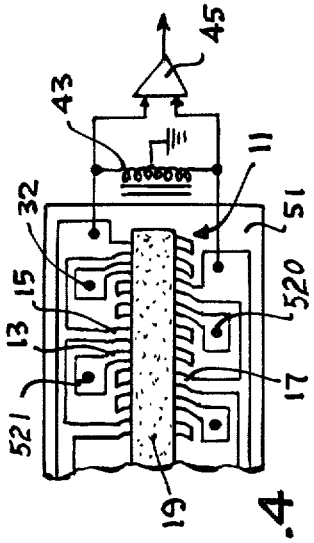
FIG. 4 is a schematic view of a portion of the photoelectric organ of FIGS. 2 and 3 illustrating in plane view one of the photocell assemblies of the organ.

FIG. 4 illustrates a portion of one of the photocell arrays 11 of the photoelectric organ. A glass substrate 51, which is mounted on the stationary disc 11*a* illustrated in FIG. 2, has deposited thereon a metallic electrically conducting circuit pattern composed of the interdigitated members 13, 15 and 17. The interdigitated members 13, 15 and 17 comprise the keying or control electrode and two collection electrodes of one photocell pair described in FIG. 2, the terminal lands of three adjacent control electrodes being indicated as 32, 520 and 521. The photosensitive material is in the form of a strip 19 deposited on the interdigitated members 13, 15 and 17 of the electrically conducting circuit pattern. The electrodes 15 and 17 are shown electrically connected to the transformer 43 and preamplifier 45, and the control electrodes 32, 520 and 521 are indicated in FIG. 4.

Figures 5, 6, 8:
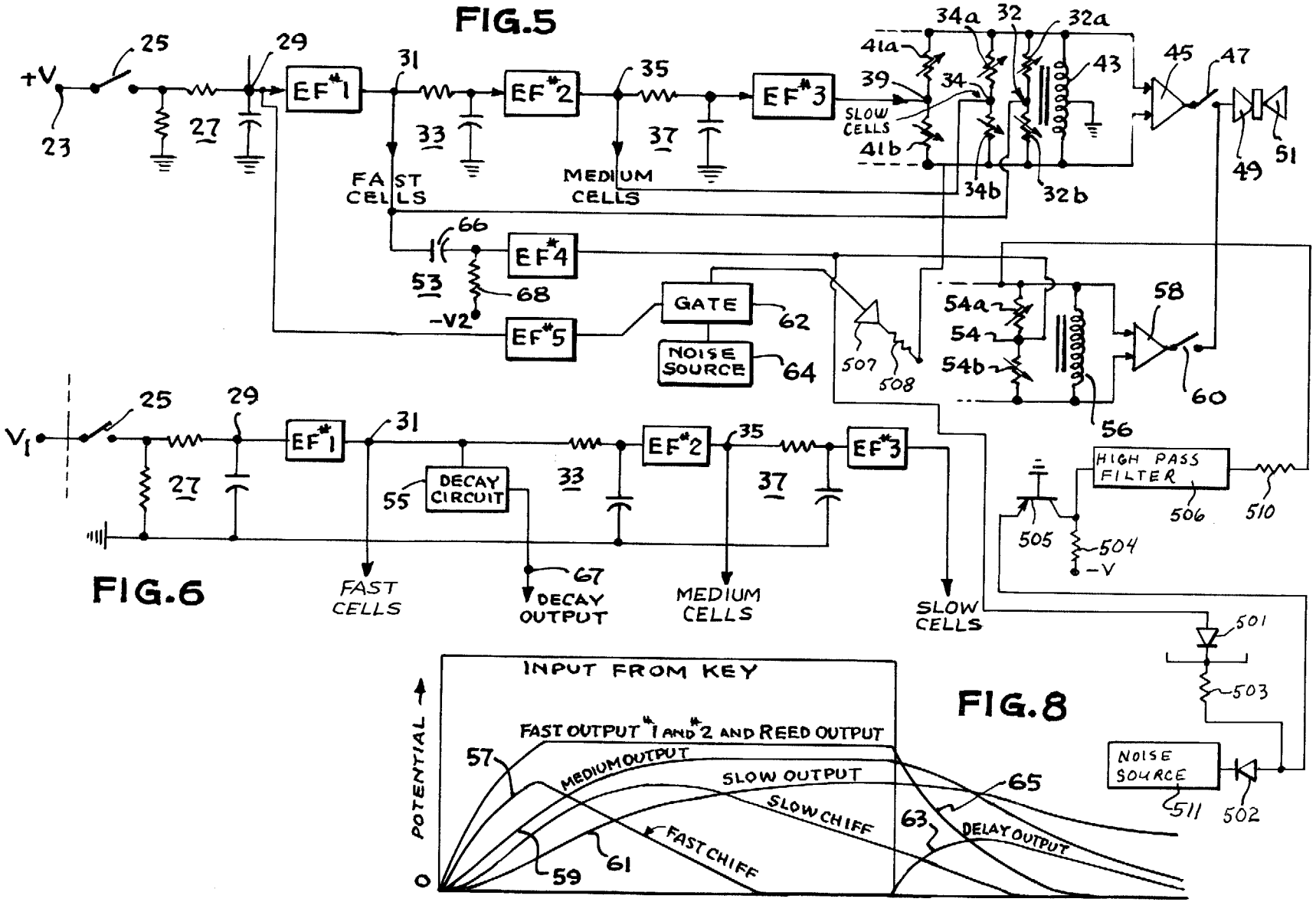
FIG. 5 is an electrical circuit diagram of a modified construction of a keying circuit constructed according to the teachings of the present invention for use in the photoelectric organ illustrated in FIGS. 2 and 4.
FIG. 6 is an electrical circuit diagram of another modified construction of a keying circuit for use in the photoelectric organ of FIGS. 2 and 4.
FIG. 8 is a graph showing the rise and decay characteristics of the keying potentials produced by the keying circuits set forth in FIG. 7.

FIG. 5 illustrates the manner in which chiff and noise components are added to the organ described in connection with FIG. 3, and identical reference numerals are used for identical parts. An additional keying circuit 53 is connected between the point 31, which produces pulses of the proper rise time for fast photocells, and an additional emitter follower designated EF No. 4. The output of the emitter follower EF No. 4 is connected to the control electrode 54 of the chiff photocells 54*a* and 54*b*. It is to be noted that the chiff photocells 54*a* and 54*b* are connected through a different transformer 56 to an amplifier 58, and the output of the amplifier 58 is connected to the input of the power amplifier 49 through a stop switch 60. Hence, the artist playing the organ has control to selectively use the chiff cells.

It will be noted that the passive elements in the keying circuit 53 include a capacitor 66 connected to the point 31 and a resistor 68 connected to a direct current potential designated as $-V_2$. Accordingly, the chiff photocells are subjected to a short pulse whenever the key switch 25 is closed as shown by the fast chiff pulse 57 in FIG. 8.

The pulse output of emitter follower EF No. 4 may also feed a noise-puff gate which consists of diodes 501 and 502 resistors 503 and 504, transistor 505 and noise source 511. The nose source 511 is biased at ground potential, so that half the time that diode 502 is conducting with the transistor 505 not conducting, and the other half of the time the transistor 505 conducts and diode 502 does not. During these latter times the current from the resistor 503 is transferred to the collector load resistor 504. Thus, random width noise pulses are produced whose amplitudes are proportional to the instantaneous value of the chiff envelope at the output of emitter follower EF No. 4. The high-pass filter 506 allows only noise components above a certain frequency to come through. This cut-off frequency varies from 1000 Hz for the low notes to 3000 Hz for the high notes. Thus a noise-puff having the desired frequency components is obtained with the same envelope as is applied to the fast chiff cells. The puff is coupled through resistor 510 to the input transformer 56 of any stop requiring the puff.

Envelope circuit 27 is also connected through an emitter follower designated EF No. 5 to the control electrode of a gate 62. The gate 62 is connected between a noise source 64 and the input of the preamplifier 45, the signal passing through amplifier 507 and resistor 508. Desirable steady noise components may thus be keyed with the same envelope as supplied to the fast cells at point 31, but the separate emitter follower EF No. 5 is required because of negative voltages from gate 62 which could get back to the fast cells if it were not for this isolation. The noise source 64 and gate 62 are more fully described in the patent application Ser. No. 368,608 of the present inventors entitled "ELECTRICAL MUSICAL INSTRUMENT", filed June 11, 1973, and will not be further described.

FIG. 6 illustrates another modified construction of the electric oxygen set forth in FIG. 3, identical reference numerals being used for identical parts. In FIG. 6, however, a decay circuit 55 is connected to point 31. The output of the decay circuit appears on point 67, as will be more fully described in connection with FIGS. 7 and 8.

Figure 7:
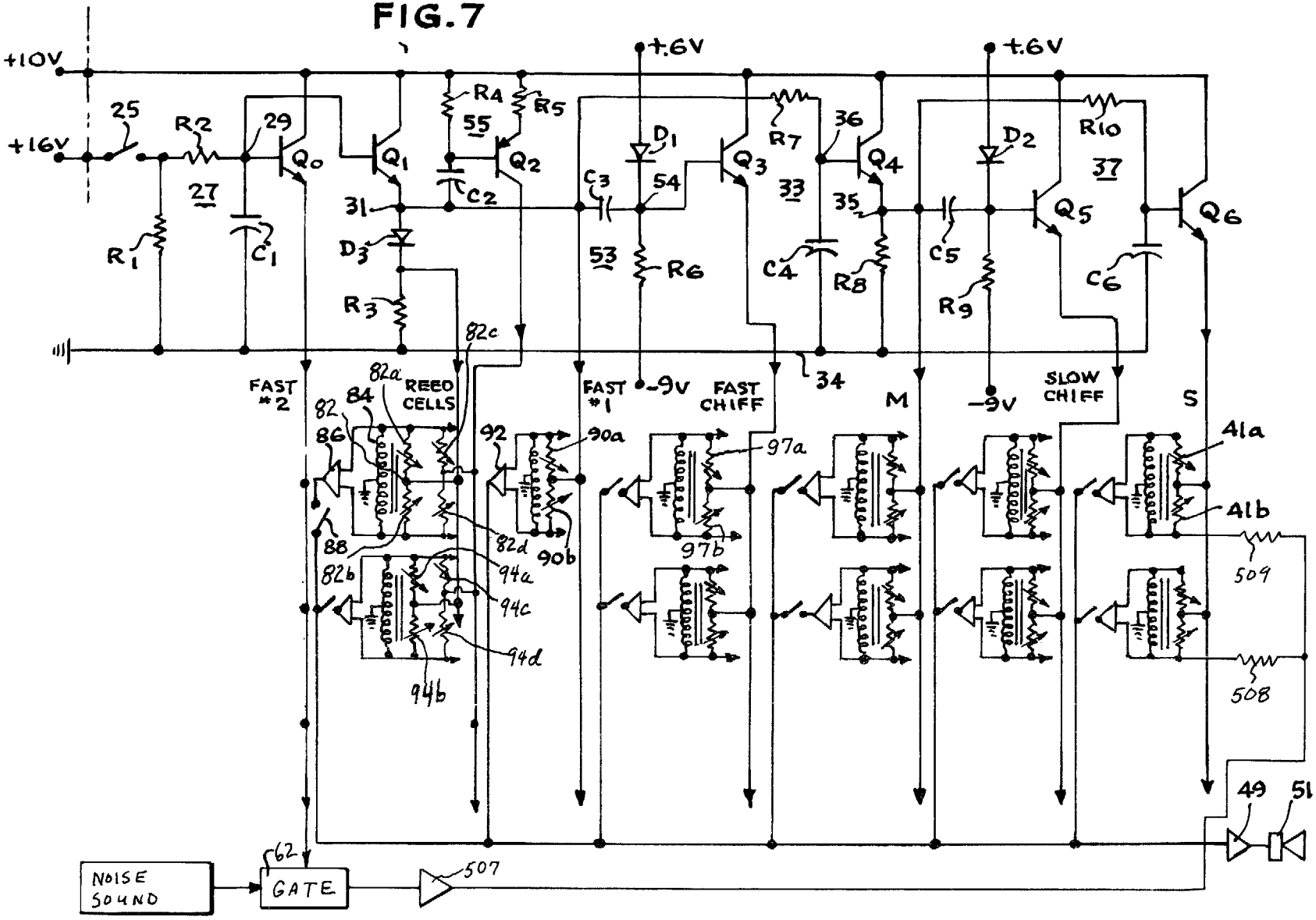
FIG. 7 is an electrical circuit diagram of a more detailed construction of a keying circuit for a photoelectric organ as illustrated in FIGS. 2 and 4.

FIG. 7 shows a preferred construction of a cascade keyer for one key switch of an electric organ together with a fragment of the photocell circuits of the electric organ. In FIG. 7, the identical elements to those described in connection with the foregoing figures bear the same reference numerals. It will be noted that in FIG. 7 the emitter follower corresponding to EF No. 1 is formed by the transistor $Q_1$, the emitter follower corresponding to EF No. 2 is formed by the transistor $Q_4$, and the emitter follower corresponding to EF No. 3 is formed by the transistor $Q_6$.

It will be noted that the transistor $Q_0$ is the emitter follower which couples the point 29 directly to the steady noise gate 62. The output of this gate 62 feeds the input transformers of several stops through an amplifier 507 and resistors 508 and 509.

The emitter follower utilizing transistor $Q_1$ excites the tone generators which produce the Reed tones. One of these tone generatoros has a control electrode 82 for photocells 82*a* and 82*b*, as well as other tone generators which will not be further described. These tone generators are also connected to the power amplifier 49 through a transformer 84, a preamplifier 86, and a stop switch 88.

As the key switch 25 is closed, a +16V direct potential is applied to the RC envelope circuit 27, the potential of point 29 rising at a rate determined by the time constant of the resistor R2 and capacitor C1. Resistor R1 also provides a decay path for capacitor C1 when the key switch 25 is opened. Hence, the decay rate of potential on the capacitor C1 is determined by the time constant of resistors R1 plus R2 in series with capacitor C1. Thus, the rising, then decaying, potential at point 29 is applied to the bases of transistors $Q_0$ and $Q_1$, both of which are connected in emitter follower circuits. It will be noted that the collectors of all transistors in the keying circuit with the exception of $Q_2$ are connected to the positive terminal of the 10 volt direct current power supply as illustrated. Thus, point 31, at the emitter of transistor $Q_1$, develops an activating potential suitable for photocells corresponding to notes requiring a fast attack and decay, the potential being available on the photocells designated 90*a* and 90*b* and other such photocells.

The potential available at point 31 is also applied by means of a diode $D_3$ to a group of photocells referred to as the Reed voices which are characterized by fast attack and fast decay. Two pairs of Reed photocells are illustrated at 82*a* and 82*b* and 94*a* and 94*b*, although it is to be understood that many more such cells are used in a complete electronic organ. The diode $D_3$ isolates the decay transient which is applied to the Reed cells from other cells connected to the point 31 and from the subsequent cascaded circuits, and further provides a decay path for capacitors C2, C3 and C4 through resistor R3.

The envelope circuit 33 is the second envelope circuit in the cascade and consists of the passive components resistor R7 and capacitor C4 connected in series between the point 31 and the common return conductor 34. Thus the potential at the point 36 (the base of transistor $Q_4$) rises when key 25 is closed at a rate determined by the series combination of envelope circuits 27 and 33. Hence, the rise time of the keying potential at point 36 will be slower than the rise time of the potential at point 31.

Resistor R8 is connected between the emitter of transistor $Q_4$ and the common connector 34 and provides a decay path for the capacitors C5 and C6.

Envelope circuit 37 is connected between the point 35 and transistor $Q_6$ and consists of resistor R10 and capacitor C6. Transistor $Q_6$ is connected in an emitter follower circuit and corresponds to emitter follower EF No. 3. The emitter of transistor $Q_6$ is connected to the slow photocells, one pair of which is designated 41*a* and 41*b*.

The fast attack output available at point 31 is coupled to the emitter follower employing transistor $Q_3$ through capacitor C3 for activating fast chiff photocells for the onset of the chiff component of the tone. Resistor R6 controls the decay of the chiff component at point 54 (the base of transistor $Q_3$), resistor R6 being connected to the return −9 volts, thus producing a decay more like a straight line function than an exponential function. The charging of capacitors C3 is stopped by diode D1 which is connected to a positive 0.6 volt potential and serves to discharge C3 quickly on opening of the key switch 25 in order to make it possible to immediately produce another transient when the key switch 25 is again closed. The fast attack chiff component is generated by tone sources using photocells designated 97*a* and 97*b* as an example in FIG. 7. The fast attack chiff component is used in conjunction with a main tone component that has a medium or slow starting time so that the chiff always occurs in advance of the main tone. It will be noted in FIG. 8 that the curve 57, which represents the fast chiff potential appearing on the emitter of transistor $Q_3$ rises ahead of the curves 59 and 61 which represent the medium onset and slow onset potentials which appear on point 35 and the emitter of transistor $Q_6$, respectively. A similar circuit consisting of capacitor C5, resistor R9, diode D2 and transistor $Q_5$ activates the slow chiff photocells.

FIG. 7 also illustrates circuits for use with Reed tones which achieve a decay at a different frequency than the frequency of the main tone. This decay output circuitry is designated 55 in FIG. 7 and couples the point 31 to other cell elements 82*c* and 82*d* and 94*c* and 94*d*. When the key switch 25 is opened, and the fast decay of the fast attack output which appears on point 31 is coupled to the base of transistor $Q_2$ through capacitor C2. Since capacitor C2 is quickly charged through resistor R4, the decay is only momentarily coupled to the base of transistor $Q_2$. This transient is inverted through transistor $Q_2$ and applied to the photocell pairs 82*c* and 82*d* and 94*c* and 94*d* which have frequencies which differ from the frequency of the main tone by one, two or three semitones. For example, if the main tone is at the frequency C2, the frequency of the decay from the tone source using the photocells 82*c* and 82*d* will be on the $D_2$ No. frequency. Hence, if key switch 25 actuates the Reed tone generator using photocells 82*a* and 82*b*, then the output of transistor $Q_2$ actuates the decay generator using photocells 82*c* and 82*d* operating at the frequency of $D_2$ No. tone. The amplitude of the output from the $D_2$ No. decay can be controlled by the emitter resistor R5. A typical curve for such a tone decay potential is shown at 63 in FIG. 8, the descending portion of which lingers on after curve 65 which is used to excite the photocells for the main Reed output.

In a particular construction, each note in the manual of a photoelectric organ is provided with a key switch and the associate cascaded keying circuits, such as illustrated in FIG. 7. A total of 215 such circuits are required for a typical three-manual organ. For the tone C3 (the next to the lowest C on the keyboard) the values of the resistors and capacitors used to obtain the desired rise times and decay times are as follows:

R1 = 3900 ohms.
R2 = 6800 ohms.
R3 = 6800 ohms.
R4 = 100,000 ohms.
R5 = 15,000 ohms.
R6 = 150,000 ohms.
R7 = 22,000 ohms.
R8 = 10,000 ohms.
R9 = 820,000 ohms.
R10 = 120,000 ohms.

C1 = 0.33 micro farads
C2 = 0.33 micro farads
C3 = 1 micro farad
C4 = 1 micro farad
C5 = 0.56 micro farads
C6 = 0.22 micro farads Higher notes will require shorter time constants.

Those skilled in the art will devise many modifications to the foregoing photoelectric organ. In particular, it should be noted that the keying circuits may be utilized with other type of tone sources which are capable of being actuated and modulated responsive to a DC potential. It is therefore intended that the scope of the present invention be not limited by the foregoing disclosure, but rather only by the inventive claims.

The invention claimed is:

1. In an electronic musical instrument, a source of direct-current potential, a first keying circuit, a key switch connected between the source and the first keying circuit, a first tone signal source corresponding to the chiff component of a desired tone, a second keying circuit connected between the first keying circuit and the first tone signal source, a second tone signal source corresponding to the main component of a desired tone and a third keying circuit connected between the first keying circuit and the second tone signal source.

2. The combination according to claim 1, wherein said keying circuits each comprise a series resistor-capacitor combination with an emitter-follower connected to each resistor-capacitor junction.

3. The combination according to claim 1, wherein the first tone signal source comprises a direct-current-actuable noise source.

4. In an electronic musical instrument, a first tone signal source having a control terminal and producing an output modulated in amplitude by the amplitude of a potential impressed upon the control terminal thereof, a source of electrical pulses having a rising leading edge and decaying trailing edge connected to the control terminal of the first tone signal source, a transistor having a base, an emitter and a collector, a capacitor electrically connected between the control terminal of the first tone signal source and the base of the transistor, a source of direct-current potential having a first and a second terminal, a first resistor electrically connected between the first terminal of the source of direct-current potential and the emitter of the transistor, a second resistor electrically connected between the first terminal of the potential source and the base of the transistor, and a second tone signal source having a control terminal connected to the collector of the transistor, said second tone signal source producing an output modulated in amplitude by the amplitude of the potential impressed upon the control terminal and the pitch of the second tone-signal source being different from the pitch of the first tone-signal source.

5. The combination according to claim 4, wherein the source of electrical pulses comprises, in series, a key switch, a third resistor and a second capacitor electrically connected between the first and second terminals of the source of direct-current potential, and an emitter follower electrically connected between the junction of the third resistor and the second capacitor and the control electrode of the first tone signal source.

6. In an electronic organ having a source of direct-current potential having a first terminal and a second terminal, a key switch having a first terminal connected to the first terminal of the source and a second terminal, a first resistor and a first capacitor connected in series between the second terminal of the key switch and the second terminal of the source, the combination comprising a first direct-current-actuable tone signal source, a first emitter follower having a first transistor having a base, an emitter and a collector, the base of the first transistor being connected to the junction between the first resistor and the first capacitor, a second emitter follower having a second transistor having a base, emitter and collector, a second resistor connected between the emitter of the first transistor and the base of the second transistor, a second capacitor connected between the base of the second transistor and the second terminal of the source, and the first tone signal source being connected to the emitter of the second transistor.

7. In an electronic organ having a source of direct-current potential having a first terminal and a second terminal, a key switch having a first terminal connected to the first terminal of the source and a second terminal, a first resistor and a first capacitor connected in series between the second terminal of the key switch and the second terminal of said source, the combination comprising a first emitter follower having a first transistor having a base, an emitter and a collector, the base of the first transistor being connected to the junction between the first resistor and the first capacitor, a second emitter follower having a second transistor having a base, an emitter and a collector, a second resistor connected between the emitter of the first transistor and the base of the second transistor, a second capacitor connected between the base of the second transistor and the, second terminal of the source, a first direct-current-actuable tone signal source connected to the emitter of the second transistor, a third emitter follower having a third transistor having a base, an emitter and a collector, a third capacitor connected between the emitter of the second transistor and the base of the third transistor, and a second direct-current-actuable tone signal source connected to the emitter of the third transistor.

8. An electrical musical instrument having a plurality of keys comprising a plurality of tone signal sources, each of the tone signal sources having a pair of control electrode terminals and producing a modulated output responsive to the magnitude of a potential impressed upon said control electrode terminals, an electrical key switch coupled to one of the keys of the musical instrument, said key switch being actuable in response to actuation of said key, a direct current source of potential, and a plurality of electrical envelope shapers, each having a pair of input terminals and a pair of output terminals and passive wave forming elements connected between the input and output terminals, said envelope shapers being connected in cascade with the input terminals of the first of said shapers connected in a series electrical circuit with the direct current source and the key switch, the output terminals of the last envelope shaper of said cascade being electrically connected to the control electrode terminals of one of the tone signal sources, whereby closing of the electrical switch impresses a potential on the one tone signal source modified by the cumulative effect of the waveform elements of the envelope shapers, and the pair of output terminals of the first of said envelope shapers being connected to the control electrode terminals of a different tone signal source, whereby closing of the electrical switch impresses a potential on said different tone signal source modified only by the waveforming elements of the first of said envelope shapers.

9. An electrical musical instrument comprising the combination of claim 8 in combination with additional tone signal sources, each of said additional tone signal sources having a pair of control electrode terminals electrically connected to the output terminals of envelope shapers in said cascade other than the first or last envelope shaper of said cascade, whereby closing of the electrical switch impresses a potential on said additional tone signal sources shaped by the passive waveform circuits between each said signal source and the direct current source.

10. An electrical musical instrument comprising the combination of claim 8 in combination with a pulse generator having a pair of input terminals electrically connected to the pair of output terminals of the first of said envelope shapers and a pair of output terminals, said pulse generator producing a single pulse responsive to each decay in output of the first envelope shaper, the pair of output terminals of the pulse generator being electrically connected to the control electrode terminals of an additional tone signal source wherein said additional tone signal source has a frequency different from said different tone signal source, whereby closing of the key switch results in actuation of the different tone signal source at a first frequency and opening of the key switch results in a decay tone signal from said additional tone signal source at a second frequency.

11. An electrical musical instrument comprising the combination of claim 8 wherein each of the tone signal sources comprises a pair of photoresistor cells connected in series, the junction between the cells being one of the control electrodes of the tone signal source, a push-pull electrical amplifier connected across the pair of photoresistor cells, and an electroacoustic transducer electrically connected to the output of the electrical amplifier.

12. An electrical musical instrument comprising the combination of claim 8 in combination with an additional electrical wave shaper having a pair of input terminals electrically connected to the output terminals of the first electrical envelope shaper and a pair of output terminals, an emitter follower having a pair of input terminals electrically connected to the output terminals of the additional wave shaper, and a chiff tone signal source having a pair of control electrodes electrically connected to the output terminals of the emitter follower, said chiff tone signal source producing an output responsive in magnitude to the potential impressed on the control electrode thereof.

* * * * *

UNITED STATES PATENT OFFICE

CERTIFICATE OF CORRECTION

Patent No. 3,930,430 Dated January 6, 1976

Inventor(s) Edward M. Jones and William C. Wayne, Jr.

It is certified that error appears in the above-identified patent and that said Letters Patent are hereby corrected as shown below:

Column 6, line 17, delete "oxygen" and insert --organ--.

Column 8, line 8, after "$D_2$", delete "No." and insert --#--.

Column 8, line 12, after "$D_2$", delete "No." and insert --#--.

Column 8, line 13, after "$D_2$", delete "No." and insert --#--.

Signed and Sealed this

Fourteenth Day of September 1976

[SEAL]

*Attest:*

RUTH C. MASON
*Attesting Officer*

C. MARSHALL DANN
*Commissioner of Patents and Trademarks*